US005806110A

United States Patent [19]

Kunz et al.

[11] Patent Number: 5,806,110

[45] Date of Patent: Sep. 15, 1998

[54] HANDICAP BATH ASSIST DEVICE

[76] Inventors: Richard Don Kunz, 6667 S. 300 West, #4, Murray, Utah 84107; Dale O. Kelsch, 2657 E. Willowbend, Sandy, Utah 84093; Lamar Clark Beynon, 168 S. 300 East, Washington, Utah 84780

[21] Appl. No.: 575,150

[22] Filed: Dec. 19, 1995

Related U.S. Application Data

[63] Continuation-in-part of Ser. No. 272,560, Jul. 11, 1994, abandoned.

[51] Int. Cl.[6] ..... A47K 3/02

[52] U.S. Cl. ..... 4/566.1; 5/644; 297/457.41

[58] Field of Search ..... 4/564.1–566.1, 4/579; 5/644, 655.3, 706, 708, 710; 297/452.41, DIG. 10

[56] References Cited

U.S. PATENT DOCUMENTS

| | | | |
|---|---|---|---|
| 2,725,578 | 12/1955 | Keller | 4/185 |
| 2,938,570 | 5/1960 | Flajole | 155/5 |
| 3,201,111 | 8/1965 | Afton | 5/655.3 X |
| 3,250,569 | 5/1966 | Gaffney | 297/330 |
| 3,346,885 | 10/1967 | Merriman | 4/185 |
| 3,479,086 | 11/1969 | Sheridan | 297/330 |
| 3,479,087 | 11/1969 | Burke | 297/339 |
| 3,803,645 | 4/1974 | Oliverius | 5/327 |
| 3,848,274 | 11/1974 | Oliver | 4/113 |
| 4,133,064 | 1/1979 | Petrusek | 5/341 |
| 4,142,263 | 3/1979 | Pierson | 5/58 |
| 4,161,794 | 7/1979 | Darnsfors | 5/441 |
| 4,243,147 | 1/1981 | Twitchell | 212/159 |
| 4,629,162 | 12/1986 | Porche | 254/93 |
| 4,768,247 | 9/1988 | Beier | 5/434 |
| 4,905,329 | 3/1990 | Heilner | 5/431 |
| 4,979,249 | 2/1990 | Meade, II | 5/441 |
| 5,020,168 | 6/1991 | Wood | 4/573 |
| 5,497,520 | 3/1996 | Kunz et al. | 5/648 |
| 5,528,783 | 6/1996 | Kunz et al. | 5/644 X |

FOREIGN PATENT DOCUMENTS

| | | | |
|---|---|---|---|
| 0266560 | 5/1988 | European Pat. Off. | 4/578.1 |
| 2679753 | 2/1993 | France | 4/566.1 |
| 4106524 | 9/1992 | Germany | 4/566.1 |
| 3840213 | 2/1993 | Germany | 4/564.1 |
| 5199946 | 8/1993 | Japan | 4/566.1 |
| 1582332 | 1/1981 | United Kingdom | 4/564.1 |
| 3024072 | 12/1993 | WIPO | 4/565.1 |

*Primary Examiner*—Charles E. Phillips
*Attorney, Agent, or Firm*—J. David Nelson

[57] ABSTRACT

A device for assisting physically handicapped persons in moving from a seated position or a standing position to a bathing position in a bathtub and then returning to a seated or standing position. This device consists of an inflatable seat of resilient material, a source of pressurized air, and pneumatically controlled valves for the controlled inflation and deflation of the seat. The seat has several sturdy walls of stiff resilient material which enhance structural stability of the seat while the seat is fully or partially inflated. The sturdy walls are connected by flexible collapse joints of flexible resilient material which allow predictable and compact folding of the sturdy walls as the seat is deflated. A flexible top and flexible side walls of flexible resilient material permit and conform to the folding of the sturdy walls in deflation. The seat is secured in place in the end of the tub opposite the water source by suction cups on the bottom and rear wall of the seat. The handicapped person is seated on the top of the seat while it is fully inflated and then the seat is deflated by actuating a deflation valve, lowering the handicapped person to the bathing position. When bathing is completed, the seat is inflated, raising the handicapped person to a seated position.

28 Claims, 2 Drawing Sheets

HANDICAP BATH ASSIST DEVICE

PRIOR RELATED APPLICATIONS

This application is a continuation-in-part application for a previously filed and pending U.S. application Ser. No. 08/272,560, filed on Jul. 11, 1994 now abandoned, by the inventors named in this application. Upon the acceptance of this continuation-in-part application by the Patent and Trademark Office as being complete and in proper form for examination, it is the intent of the inventors that the prior related application identified above be abandoned.

FIELD OF THE INVENTION

This invention relates to devices for assisting physically handicapped persons in moving to and from a bathing position in a bathtub.

BACKGROUND OF THE INVENTION

There has long been recognized a need for physical assistance of handicapped persons into and out of a bathing position in a bathtub. This need includes the need for physically assisted self-help for persons who are handicapped by virtue of a physical disability or age disability who reside at home or in other settings where assistance from others is limited or non-existent. It also includes the need for physical assistance for persons who help physically handicapped persons with bathing. Obtaining the bathing position in a traditional residential bathtub as well as other bathing basins in most institutional settings is physically impossible or extremely taxing for persons with certain physical handicaps or infirmities of age.

Simple, affordable devices, particularly devices providing self-help in bathing are virtually non-existent. Devices employing harnesses, pulleys and cables suspended from overhead support are well known in the institutional setting. One such device is disclosed in U.S. Pat. No. 4,243,147 to Twitchell. These devices are cumbersome, expensive, and typically are not operated by the handicapped person. Also, these types of devices generally cannot be adapted for most residential applications. One of the greatest unfulfilled need arises in a residential setting where handicapped persons reside alone or with family members or friends. Similarly, in retirement centers and nursing homes with limited budgets and manpower, there is a substantial unfulfilled need.

Devices employing mechanical means such as motors, chains, pulleys, cables are generally undesirable because they are bulky, complex and raise safety concerns for utilization around water. For the present invention, the inventor has employed a pneumatically actuated system. While the present invention could be hydraulically actuated, such a system likely would be somewhat more complex and costly. With a pneumatically actuated system, the basic objectives of simplicity, workability, comfort and safety can readily be achieved.

Several inflatable or pneumatically operated devices have been developed for the positioning of handicapped or otherwise physically limited persons. U.S. Pat. No. 4,979,249 to Meade, discloses an inflatable cushion activated by a hand operated air pump and an adjustable valve. This device provides a means of adjustably elevating the head or other parts of the body and provides for controlled deflation, allowing a person to obtain sleep with an inflated cushion, with the cushion being deflated after sleep is attained.

U.S. Pat. No. 3,848,274 to Oliver discloses an inflatable bed pan. This device allow insertion of the deflated bed pan with substantially reduced effort on the part of the assisting person and with little or no assistance from the handicapped person. The handicapped person is then raised to the use position as the device is inflated.

U.S. Pat. No. 3,803,645 to Oliverius discloses an inflatable device for positioning and support of the feet or legs of a handicapped person.

U.S. Pat. No. 4,629,162 to Porche discloses an inflatable cushion for assisting a handicapped person in moving from a standing position to a seated position in a chair and returning from the seated position to a standing position. A similar device employing a ring-shaped inflatable cushion is disclosed in U.S. Pat. No. 4,905,329 to Heilner. Similar devices employing both pneumatic and mechanical means are disclosed in U.S. Pat. No. 3,250,569 to Gaffney, U.S. Pat. No. 3,479,086 to Sheridan, and U.S. Pat. No. 3,479,087 to Burke.

U.S. Pat. No. 5,020,168 to Wood discloses an inflatable chair for use in bathing handicapped persons in a bathtub. This device provides for the positioning of handicapped persons in a desired bathing position and securing that handicapped person in that desired position until bathing is completed. It does not provide assistance to the handicapped person in obtaining the bathing position from a standing or seated position, or in returning to a standing or seated position subsequent to the completion of bathing.

U.S. Pat. No. 2,725,578 to Keller discloses an inflatable bathtub seat. This device is an inflatable stool in the form of a cylindrical bellows which is inflated with water from the bathwater source. This device depends for its questionable stability against overturning and its ordered deflation on a cumbersome combination of metal rails and metal lazy tongs. This device has obvious comfort, complexity and stability problems.

European Patent No. 0266560 to Falconer discloses an inflatable bath seat constructed of a polymeric material which is similar in function to the device disclosed in Keller. This device, like the device disclosed in Keller, is basically an inflatable stool which is inflated with bathwater. A bellows or undulated crossection promotes a somewhat compact collapse of the seat in deflation. Tapering of the cylinder from bottom to top provides for the nesting of successive folds of the bellows as the seat is deflated. This seat has stability problems similar to the device disclosed in Keller, but has the advantage of having a base which is larger than the the seat top. Like the device disclosed in Keller, it does not derive any stability from the sides or rear of the bathtub. Like the device disclosed in Keller, the safety of this device, particularly for those persons of substantial infirmity, is in question.

Similarly, the device disclosed in French Patent 2679753 to Van Schaijik is also merely an inflatable stool. This device has a triangular shaped seat and is essentially just an inflatable cushion. Unlike the device disclosed in the Halcyon Projects patent, this device has no means for promoting the predictable collapse of the cushion. Like the Halcyon Projects device, it derives no stability from contact with the sides or rear of the tub.

The device disclosed in Japanese Patent No. 5199946 to Imamura is also a belows type inflatable bath seat with a rigid seat plate, and is very similar to the device disclosed in Keller. However, the device disclosed in Imamura is formed specifically with, and made an integral part of, a bathtub. The Imamura device comprises a rigid seat plate that forms the top, movable portion of the bellows. The opposite or bottom portion of the bellows is formed by the bathtub itself.

It appears that an air compressor supplies pressurized air to inflate the bellows to raise the seat from a deflated to an inflated position. The inflation/deflation nozzle is formed with, and as a part of, the bottom portion of the bathtub, the bottom surface of the bellows being hermetically sealed to the seat in order to effect the air-tight connection between the bathtub and the seat. Therefore, the bellows-type seat of Imamura is not portable, but rather is formed as a permanent element of the bathtub. Also note that the Imamura bellows seat is incapable of standing alone. This is inherent in bellows arrangements of this type. Therefore, the bellows seat is constrained to vertical movement, and is limited on the back by the back surface of the tub and on the front by the two vertical guides to maintain vertical stability of the device in partially inflated and fully inflated configurations. In addition, vertical stops are required to limit the upper vertical travel of the bellows seat to make sure that it is not inflated beyond the top of the guides, which would result in a loss of stability.

British Patent 1582332 to Tideslock discloses an inflatable supporting bag with two inflatable compartments, one of which supports the head and the other supports the torso of a person being bathed. When both compartments are inflated the head is supported to a higher level than the torso. However, this device merely serves to lower the handicapped person from a mostly prone position at the level of the top of the tub to a mostly prone but partially submerged bathing position, with the head higher than the torso. Use of this device requires the physical lifting of the person into a prone position on the fully inflated bag before bathing and lifting the person from the fully inflated bag after bathing. The function of this device then is merely to support the head above water and to support the submerged or partially submerged torso below water during bathing. The Tideslock device provides no practical assistance for seating, unseating and bathing of the handicapped person in a seated position.

U.S. Pat. No. 3,346,885 to Merriman discloses an inflatable bath seat which is merely an inflatable cushion with suction cups on the side that have to be manually engaged to hold the cushion in place. It has no features to provide for the controled or predictable collapse of the cushion. In a partially deflated configuration, the user will sink into the cushion, and in a fully inflated configuration, the top of the cushion is rounded up. There are no features to provide for stability of the seating in a partially inflated configuration. An optional board may be attached to the top of the cushion, to reduce the tendency of the user to slip off the cushion.

German Patent 3840213 to Lochle discloses an inflatable bath seat which has an inflatable bottom cushion, and inflatable back and side cushions, which are interconnected. As the bottom cushion inflates it will tend to inflate more in the middle, as it is connected on its sides to the bottom of the side cushions and the bottom of the back cushion. The result is a bottom cushion which provides less stable support the more it is inflated. There is also no means to provide for the orderly and predictable collapse of the bottom cushion in deflation.

All of the inflatable devices disclosed above potentially are self-help devices, as they can be operated by the handicapped person. Also, each of them could be powered by a remote pneumatic source with the operator utilizing a valve to introduce air into the inflatable device. However, none of them achieve the objectives of the present invention.

One object of the present invention is to provide a bath assist device for handicapped persons which is readily adaptable to typical residential bathtub use.

Another object of the present invention is to provide a handicap bath assist device that is reasonably affordable.

A further object of the present invention is to provide a handicap bath assist device that is simple and safe to operate and which can be readily operated by the handicap person or an assisting person from the use position.

A further object of the present invention is to provide a bath assist device that is pneumatically actuated from a pneumatic source which is remotely located from the use location and has no requirement for electrical components at the use location.

A further object of the present invention is to provide a handicap bath assist device that is comfortable to the handicap person in the bathing position and all other use positions.

A further object of the present invention is to provide a handicap bath assist device that is mechanically reliable and easy and inexpensive to repair.

A further objective of the present invention is to provide a handicap bath assist device that is stable and therefore provides safe support for the handicapped person in fully inflated, partially inflated and fully deflated configurations.

A further objective of the present invention is to provide a handicap bath assist device that will predictably and repeatedly fold and contract to a uniform compact and comfortable position upon deflation.

A still further object of the present invention is to provide a handicap bath assist device that is portable and therefore adaptable to multiple use locations in a typical home setting and to multiple users in an institutional setting such as a retirement home, nursing home or hospital.

SUMMARY OF THE INVENTION

The invention provides a device for assisting handicapped persons in moving from a standing or seated position to a bathing position in a bathtub and thereafter returning to a standing or seated position. The device is of simple construction, from readily available, relatively inexpensive materials. The device is easy and safe to operate and comfortable for the handicap person in all use positions. It is very compact in the deflated position making it readily adaptable to home bathtub use. It is mechanically reliable and easy to maintain and repair. It can be operated with common low-pressure pneumatic sources, such as a compressor or blower and will typically only require a remote household power source.

This invention comprises an inflatable seat, sized to fit snugly, in partially and fully inflated configurations, in the end of a bathtub opposite the water source, with collapsible joints which promote predictable and repeatable collapse of the seat into a compact and comfortable position as it is deflated to the bathing position. Preferably the top of the seat is contoured for the comfort of the handicapped person in fully inflated, partially deflated, and fully deflated configurations. The seat preferably has a single air chamber with a single coupling for an air hose from a pressurized air source. The device also has pneumatically actuated valves for inflating and deflating the seat. These valves are actuated by pneumatic switches which are accessible to the handicapped person or the person assisting the handicapped person in the use position.

To use the device, an inflation switch is actuated which opens an inflation valve allowing air at an adjustable rate into the seat. The seat inflates to the fully inflated position and the inflation switch is deactuated. The handicapped person seats himself or is assisted in seating himself on the seat and the deflation switch is actuated, allowing air to escape at an adjustable rate from the seat. The seat is partially deflated or fully deflated, as desired by the handicapped person or the assisting person. If partial deflation is desired, the deflation switch is deactuated when the desired degree of deflation is obtained. If full deflation is desired, the deflation switch is deactuated when the seat is fully deflated. After bathing is complete, the inflation switch is actuated allowing air into the seat. The seat is inflated at an adjustable rate which causes the handicapped person to be lifted to a seated position on the fully inflated seat, and the inflation switch is deactuated. The handicapped person then can either stand in the tub and step over the side of the tub or swing his legs over the side of the tub in a seated position and stand or be transferred to a wheelchair, with or without assistance, as the case may be. The seat can be retained in its inflated configuration until the time of the next desired use or it can be deflated and retained in place where it will be unobstructive for the users of the bathtub who do not require assistance. The device also can be removed and transported to other tubs in the home or to other user locations.

Persons providing home assistance to handicapped persons may utilize the same device at a number of locations to assist in bathing of their handicapped patients. Likewise, retirement centers or nursing homes may utilize the device at a number of bathing locations, or may make the device available for use by residents in their rooms.

DETAILED DESCRIPTION OF THE PREFERRED EMBODIMENTS

Figure 1:
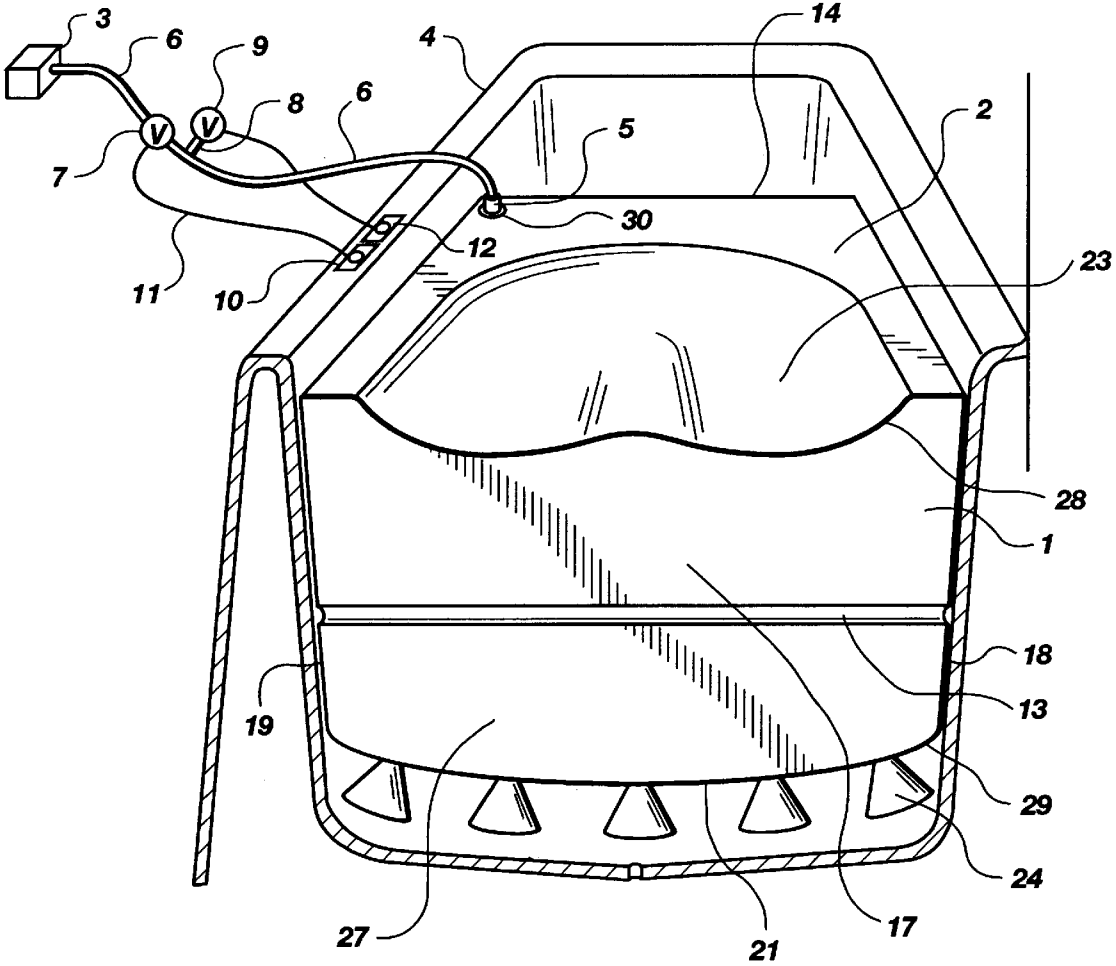
FIG. 1: A front view of the handicap assist device in a fully inflated configuration.

A preferred embodiment of a handicap bath assist device 1, appears generally in FIG. 1 as deployed in a bathtub 4 or other bathing basin, and comprises an inflatable seat 2, a pressurized air source 3, a coupling 5, an inflation air hose 6, an inflation valve 7, a deflation air hose 8, a deflation valve 9, an inflation switch 10, air hose from the inflation switch to the inflation valve 11, a deflation switch 12, and air hose 31 from the deflation switch to the deflation valve 9.

Figure 2:
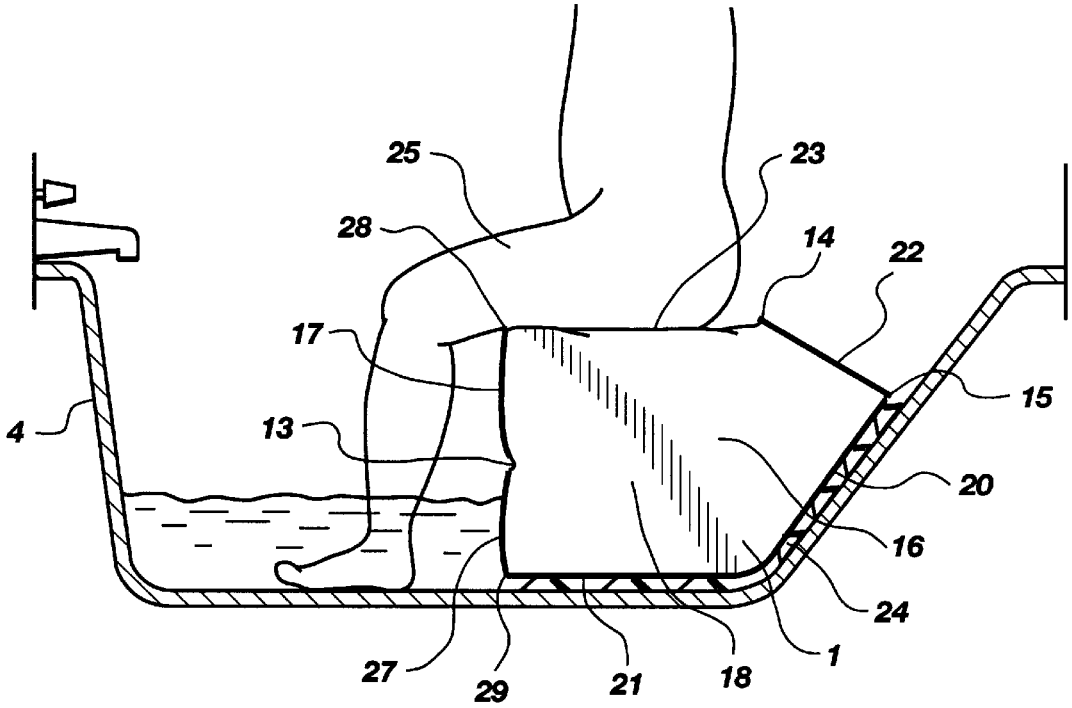
FIG. 2: A side view cross-section of the handicap bath assist device in a fully inflated configuration.

Referring also to FIG. 2, in a preferred embodiment of the invention, the seat 2 is constructed of rubber or other resilient material, with soft collapse joints 13, 14, 15, 28, 29 at key folding locations for compact deflation. The seat has an air inlet which preferably consists of an inflation coupling 5 which allows easy connection and disconnection of the inflation air hose 6 to the seat. The coupling can be any of a number of well known devices. Under a preferred embodiment, there is a single air connection 5 to the seat which serves both as an air inlet and an air outlet. Under this embodiment both the inflation valve 7 and deflation valve 9 connect to the same hose 6. A venturi tube or other type of suction device may be used in conjunction with the deflation valve in order to speed the deflation of the seat.

In a preferred embodiment, the seat has a single air chamber 16, promoting ease of inflation and deflation, but other embodiments may provide a seat with two or more chambers.

The seat has a top front wall 17, a bottom front wall 27, a left side wall 18, a right side wall 19, a rear wall 20, a base wall 21, a support wall 22, and a top 23. The side walls, the base wall and the rear wall bear against the corresponding inside surfaces of the bathtub. Under a preferred embodiment of the invention, suction cups 24 are attached to or are an integral part of the base wall 21 and rear wall 20 of the seat to anchor the seat to the bottom and rear of the tub, so as to prevent movement during use.

Under a preferred embodiment, the top front wall, the bottom front wall, the base wall, the rear wall, and the support wall are sturdy and are constructed of heavy duty rubber, and the left side wall, the right side wall, and the top are flexible and are constructed of a lighter gauge, softer, flexible rubber. Under other preferred embodiments the walls and the top may be constructed of other types of resilient material. Under preferred embodiments all adjoining walls are flexibly connected and the walls adjoining the top are flexibly connected to the top. This is accomplished in preferred embodiments by the soft collapse joints 13, 14, 15, 28, 29 which are constructed of lighter gauge, softer, flexible rubber or other resilient material.

For preferred embodiments, all walls and the top are constructed of resilient material of the same general chemical composition, such as rubber. The sturdy walls are constructed of heavy duty, stiff, resilient material as they are not intended to be flexed to any significant degree during use. The flexible walls are constructed of lighter gauge, soft, flexible material. The soft collapse joints are likewise constructed of lighter gauge, soft, flexible material. For some preferred embodiments, the sturdy walls will be constructed of material of an identical chemical composition to the flexible walls, with the only difference being the thickness of the material. Likewise, the collapse joints are made of material which is identical in composition and thickness to the material from which the flexible walls are made or are made from even thinner material of the same composition. While under preferred embodiments, all walls and the top are constructed of material of the same general chemical composition, other embodiments of the invention may provide for the sturdy walls, the flexible walls or the collapse joints to be constructed of resilient material of a different chemical composition than the others, in order to accomplish specific objectives which are well known to those skilled in the art, such as an enhancement of the durability of the collapse joints.

A preferred embodiment provides for a front top collapse joint 28 between the top and the top front wall, a front wall collapse joint 13 between the top front wall and the bottom front wall, a front base collapse joint 29 between the bottom front wall and the base wall, a rear wall collapse joint 15 between the rear wall 20 and the support wall 22, and a rear top collapse joint 14 between the top 23 and the support wall 22. Preferably the dimension of the top front wall from the top to the front wall collapse joint is equal to the dimension of the bottom front wall from the front wall collapse joint to the front base collapse joint.

Under a preferred embodiment, the top 23 is contoured for the comfort of the user. However, for other embodiments, the top may have a separate or integral cushion for the comfort of the user. The top may also be without contours to facilitate the user pivoting between a legs-in-the-tub position and a legs-over-the-side position. A detachable rigid top may also be used.

Figure 3:
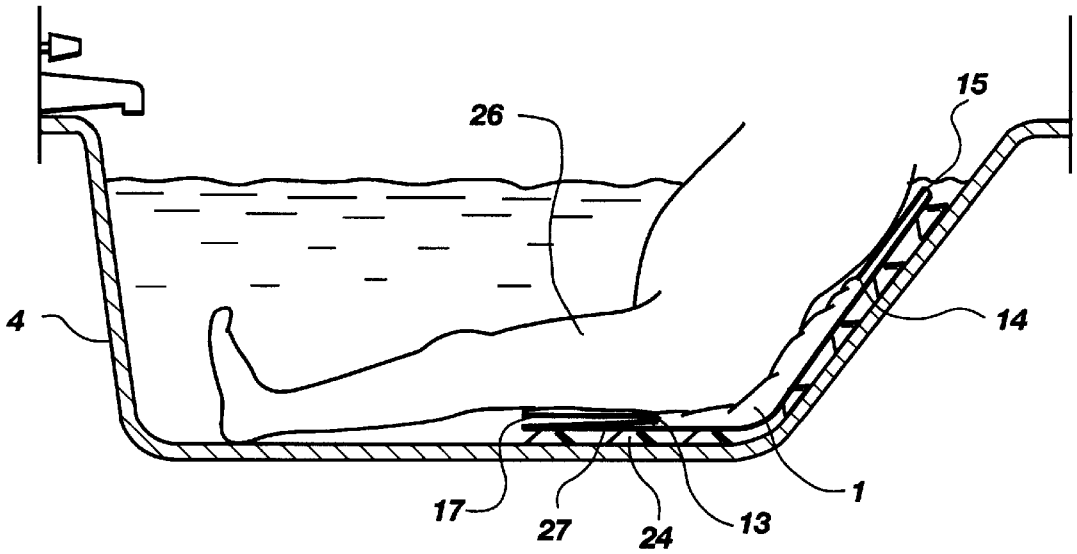
FIG. 3: A side view cross-section of the handicap bath assist device in a fully deflated configuration.

As the fully inflated seat shown in FIG. 2 is deflated, the sturdy base wall 21 prevents displacement of the bottom of bottom front wall 27, while the front base collapse joint 29 allows rotation of the top of the bottom front wall toward the rear of the tub. The flexible side walls 18, 19 allow the top of the bottom front wall and the bottom of the top front wall 17 to move toward the rear of the tub. This causes the top front wall to fold onto the bottom front wall, as shown in FIG. 3 as the seat is deflated. At the same time, the sturdy rear wall 20 prevents the displacement of the bottom of the support wall 22, while the flexible side walls 18, 19, the rear wall collapse joint 15, the top rear collapse joint 14, and the flexible top 23 allow the top of the support wall to rotate downward. This causes the support wall to fold onto the rear wall as the seat is deflated, as shown in FIG. 3. The predictable folding of the sturdy walls, which is permitted by the flexible side walls and top and the collapse joints, provides for the predictable and compact nesting of the sturdy walls when the seat is fully deflated, as shown in FIG. 3, with the flexible side walls and the flexible top conforming to the nesting of the sturdy walls.

The sturdy walls and the interconnection of those walls as shown in FIG. 2, results in enhanced stability of the seat in fully inflated and partially deflated configurations. In particular the top front wall, the bottom front wall and the support wall, provide substantial stability to the seat in fully inflated and partially deflated configurations. Because of the manner in which they fold and unfold, they provide structural support for the seat along the front and the back edges of the seat, whether the seat is fully inflated or partially deflated.

Under a preferred embodiment, the inflation pressure for the seat is low. Under this preferred embodiment, the air source may be a low pressure compressor or a blower. Under a preferred embodiment, the air source 3 is connected to the seat 2 by an air hose 6 only. This keeps all electric motors outside of the use area of the seat, thereby limiting or reducing the chance of electric shock by the handicapped person or an assisting person. Under a preferred embodiment, the air supply 3 to the seat 2 is controlled by a pneumatically operated inflation valve 7. The inflation valve is actuated by a pneumatic inflation switch 10 which is directly accessible to the handicapped person or an assisting person in the use area. The inflation valve is adjustable so that the rate of inflation can be controlled to a desired rate. Likewise, deflation of the seat is controlled by a pneumatically operated deflation valve 9 which is actuated by a pneumatic deflation switch 12 accessible to the handicap person or an assisting person in the use area. The deflation valve is also adjustable so that the rate of deflation can be controlled to a desired rate. A venturi tube or other suction device may be utilized in conjunction with the deflation valve to speed up the deflation of the seat. Under a preferred embodiment, the inflation valve 7 is also equipped with an automatic shutoff which shuts off the inflation valve and stops inflation of the seat when a predetermined maximum pressure in the seat is reached. Likewise, under a preferred embodiment, the deflation valve is equipped with an automatic shutoff which shuts off the deflation valve when the pressure in the seat drops to zero or some other pre-determined minimum pressure.

Under preferred embodiments, an air inlet 30 and an air outlet 30 have a common orifice in the top of the seat. However, other embodiments may provide for the air inlet and the air outlet to have separate orifices in the seat. Also, under other embodiments either or both of the valves may be attached directly to the seat. Under other embodiments, a three-way valve may also be used instead of separate inflation and deflation valves.

In preferred embodiments of the invention, the switches controlling the inflation valve and the deflation valve are pneumatically actuated. However, other embodiments may utilize low voltage electrical switches which can provide a reasonable degree of safety despite the wet environment at the use location. The valves may also be low voltage electric with wireless, battery powered switches. Also, the valves may located outside the use location, away from the water hazard, thereby allowing the use of common electrical valves. Battery powered, remote, wireless switches facilitate the use of such valves.

A preferred embodiment of the invention provides hand actuated switches for the inflation valve and the deflation valve. These switches are located at a position where they can be reached easily by the user or an assisting person from the various use positions. Another preferred embodiment provides foot actuated switches which allow an assisting person to have both hands free to assist the handicap person while actuated the inflation valve or the deflation valve.

Embodiments of the invention may provide a belt which is attached to the seat which allows the user to be secured to the seat during use.

Under a preferred embodiment a handicapped person is assisted by the device by being seated 25 as shown in FIG. 2 on the seat 1 in its fully inflated configuration and being lowered into the tub to the bathing position 26 as shown in FIG. 3 by actuating the deflation switch 12. If only partial deflation is desired, the deflation switch is deactuated when the desired degree of deflation is obtained. After bathing is completed, the handicapped person is returned to the seated position by actuating the inflation switch 10. When the seat is fully inflated, the inflation switch is deactuated. The handicap person may then either stand in the tub and step out of the tub, with or without assistance as the case may be, or may swing his legs over the side of the tub for standing or transfer to a wheelchair, again with or without assistance as the case may be.

Under another embodiment of the invention, the top of the seat is inclined toward the front and extends above the top of the tub on the back, thereby imparting forward as well as upward thrust to the handicapped person upon inflation of the seat. This embodiment provides additional assistance to the handicapped person in standing when the device is in its fully inflated configuration.

Under preferred embodiments of the invention, the seat 2 is inflated through pressurized air. However, embodiments of the invention can provide for the seat 2 to be inflated hydraulically through the use of culinary water pressure with the water being bled into the tub or into a drain when deflating to the bathing position. This would allow the device to be operated without any independent source of power. The device could also be hydraulically actuated by a low-pressure hydraulic system.

Under a preferred embodiment of the invention, the seat is equipped with one or more handles on the top of the seat, thereby enhancing the portability of the device for use in multiple locations or with multiple users.

Under a preferred embodiment, the seat is sized so that it extends from the end of the tub opposite the faucet to a position where the user can easily reach the faucet from the fully inflated and the fully deflated configurations.

Other embodiments of the invention and other variations and modifications of the embodiments described above will be obvious to a person skilled in the art. Therefore, the foregoing description is intended to be merely illustrative of the invention and the invention is limited only by the following claims.

What is claimed is:

1. A handicap bath assist device comprising:

a) an inflatable seat which is dimensioned to fit, in a fully inflated configuration, in an end of a bathtub, said seat comprising:

(1) a plurality of sturdy walls of stiff resilient material providing structural stability to said seat;

(2) a plurality of collapse joints of flexible resilient material flexibly connecting said sturdy walls and providing for predictable and compact collapse of the seat and nesting of said sturdy walls in deflation and providing for unfolding of said sturdy walls to expand the seat during inflation;

(3) a flexible top and a plurality of flexible side walls of flexible resilient material that permit and conform to nesting and unfolding of said flexibly connected sturdy walls;

b) an air inlet to the seat;

c) means for controllably supplying pressurized air to the seat through the air inlet;

d) an air outlet from the seat; and e) means for controllably bleeding air from the seat through the air outlet.

2. A handicap bath assist device as claimed in claim 1 wherein the inflatable seat has one or more suction cups on the exterior surface of the seat, each suction cup positioned so that it contacts the bathtub during use.

3. A handicap bath assist device as claimed in claim 1 wherein the inflatable seat is constructed of rubber, the sturdy walls being constructed of heavy duty and stiff rubber, the flexible top and flexible side walls being constructed of soft and flexible rubber, and the collapse joints being constructed of soft and flexible rubber.

4. A handicap bath assist device as claimed in claim 1 wherein the means for controllably bleeding air from the seat includes a means for accelerated evacuation of the air.

5. A handicap bath assist device as claimed in claim 1 wherein the means for controllably bleeding air from the seat comprises deflation air hose, a deflation air valve, a deflation valve switch, a venturi suction device, a source of pressurized air for the venturi suction device, and a means for connecting the deflation air hose to the air outlet.

6. A handicap bath assist device as claimed in claim 1 wherein the air inlet and the air outlet have a common orifice.

7. A handicap bath assist device as claimed in claim 1 wherein the means for controllably supplying pressurized air to the seat comprises inflation air hose, an inflation air valve, an inflation valve switch, a pressurized air supply, and a means for connecting the inflation air hose to the air inlet.

8. A handicap bath assist device as claimed in claim 1 wherein the means for controllably bleeding air from the seat comprises deflation air hose, a deflation air valve, a deflation valve switch, and a means for connecting the deflation air hose to the air outlet.

9. A handicap bath assist device as claimed in claim 1 wherein the means for controllably supplying pressurized air to the seat comprises inflation air hose, an inflation air valve, an inflation valve switch, a pressurized air supply, and a means for connecting the inflation air hose to air inlet, and the means for controllably bleeding air from the seat comprises deflation air hose, a deflation air valve, a deflation valve switch, and a means for connecting the deflation air hose to the air outlet.

10. A handicap bath assist device comprising:

a) an inflatable seat which is dimensioned to fit, in a fully inflated configuration, in an end of a bathtub, said seat comprising:

(1) a top front wall, a bottom front wall, a base wall, a rear wall, and a support wall, all being sturdy walls constructed of stiff resilient material providing structural stability to said seat;

(2) a top, a left side wall, and a right side wall, all being flexible walls constructed of flexible resilient material that permit and conform to nesting and unfolding of said sturdy walls;

(3) a front top collapse joint between the top and the top front wall, a front wall collapse joint between the top front wall and the bottom front wall, a front base collapse joint between the bottom front wall and the base wall, a rear wall collapse joint between the rear wall and the support wall, and a rear top collapse joint between the top and the support wall, all collapse joints being of flexible resilient material flexibly connecting said sturdy walls and providing for predictable and compact collapse of the seat and nesting of said sturdy walls in deflation, and providing for unfolding of said sturdy walls to expand the seat during inflation;

b) an air inlet to the seat;

c) means for controllably supplying pressurized air to the seat through the air inlet;

d) an air outlet from the seat; and e) means for controllably bleeding air from the seat through the air outlet.

11. A handicap bath assist device comprising:

a) an inflatable seat which is dimensioned to fit, in a fully inflated configuration, in an end of a bathtub, said seat comprising:

(1) a top front wall, a bottom front wall, a base wall, a rear wall, and a support wall, all being sturdy walls constructed of heavy duty and stiff rubber providing structural stability to said seat;

(2) a top, a left side wall, and a right side wall, all being flexible walls constructed of soft and flexible rubber that permit and conform to nesting and unfolding of said sturdy walls;

(3) a front top collapse joint between the top and the top front wall, a front wall collapse joint between the top front wall and the bottom front wall, a front base collapse joint between the bottom front wall and the base wall, a rear wall collapse joint between the rear wall and the support wall, and a rear top collapse joint between the top and the support wall, all collapse joints being of soft and flexible rubber flexibly connecting said sturdy walls and providing for predictable and compact collapse of the seat and nesting of said sturdy walls in deflation, and providing for unfolding of said sturdy walls to expand the seat during inflation;

b) an air inlet to the seat;

c) means for controllably supplying pressurized air to the seat through the air inlet;

d) an air outlet from the seat; and e) means for controllably bleeding air from the seat through the air outlet.

12. A handicap bath assist device comprising:

a) an inflatable seat having a plurality of sturdy walls of stiff resilient material which sturdy walls provide structural stability to said seat and which are flexibly connected by a plurality of collapse joints of flexible resilient material, said collapse joints providing for predictable and compact collapse of the seat and nesting of said sturdy walls in deflation and providing for unfolding of said sturdy walls to expand the seat during inflation; said seat having a flexible top and a plurality of flexible side walls of flexible resilient material that permit and conform to nesting and unfolding of said flexibly connected sturdy walls; and said seat being dimensioned to fit, in a fully inflated configuration, in an end of a bathtub;

b) an air inlet to the seat;

c) an inflation air hose;

d) an inflation coupling for connecting the inflation air hose to the air inlet;

e) a pressurized air supply;

f) an inflation valve for admitting air to the seat through the inflation air hose and the air inlet;

g) an inflation switch for actuating the inflation valve;

h) an air outlet;

i) deflation air hose;

j) a deflation coupling for connecting the deflation air hose to the air outlet; and k) a deflation valve for bleeding air from the seat.

13. A handicap bath assist device as claimed in claim 12 wherein the inflatable seat has one or more suction cups on the exterior surface of the seat, each suction cup positioned so that it contacts the bathtub during use.

14. A handicap bath assist device as claimed in claim 12 wherein the inflatable seat is constructed of rubber, the sturdy walls being constructed of heavy duty and stiff rubber, the flexible top and flexible side walls being constructed of soft and flexible rubber, and the collapse joints being constructed of soft and flexible rubber.

15. A handicap bath assist device as claimed in claim 12 further comprising a venturi suction device and a source of pressurized air for the venturi suction device.

16. A handicap bath assist device as claimed in claim 12 further comprising a means for accelerated evacuation of the air during deflation.

17. A handicap bath assist device as claimed in claim 12 wherein the air inlet and the air outlet have a common orifice.

18. A handicap bath assist device as claimed in claim 12 wherein the air inlet and the air outlet have a common orifice and the deflation air hose is connected to the inflation air hose between the air inlet and inflation valve.

19. A handicap bath assist device comprising:

a) an inflatable seat which is dimensioned to fit, in a fully inflated configuration, in an end of a bathtub, said seat comprising:

(1) a top front wall, a bottom front wall, a base wall, a rear wall, and a support wall, all being sturdy walls constructed of stiff resilient material providing structural stability to said seat;

(2) a top, a left side wall, and a right side wall, all being flexible walls constructed of flexible resilient material that permit and conform to nesting and unfolding of said sturdy walls;

(3) a front top collapse joint between the top and the top front wall, a front wall collapse joint between the top front wall and the bottom front wall, a front base collapse joint between the bottom front wall and the base wall, a rear wall collapse joint between the rear wall and the support wall, and a rear top collapse joint between the top and the support wall, all collapse joints being of flexible resilient material flexibly connecting said sturdy walls and providing for predictable and compact collapse of the seat and nesting of said sturdy walls in deflation, and providing for unfolding of said sturdy walls to expand the seat during inflation;

b) an air inlet to the seat;

c) an inflation air hose;

d) an inflation coupling for connecting the inflation air hose to the air inlet;

e) a pressurized air supply;

f) an inflation valve for admitting air to the seat through the inflation air hose and the air inlet;

g) an inflation switch for actuating the inflation valve;

h) an air outlet;

i) deflation air hose;

j) a deflation coupling for connecting the deflation air hose to the air outlet; and k) a deflation valve for bleeding air from the seat.

20. A handicap bath assist device comprising:

a) an inflatable seat which is dimensioned to fit, in a fully inflated configuration, in an end of a bathtub, said seat comprising:

(1) a top front wall, a bottom front wall, a base wall, a rear wall, and a support wall, all being sturdy walls constructed of heavy duty and stiff rubber providing structural stability to said seat;

(2) a top, a left side wall, and a right side wall, all being flexible walls constructed of soft and flexible rubber that permit and conform to nesting and unfolding of said sturdy walls;

(3) a front top collapse joint between the top and the top front wall, a front wall collapse joint between the top front wall and the bottom front wall, a front base collapse joint between the bottom front wall and the base wall, a rear wall collapse joint between the rear wall and the support wall, and a rear top collapse joint between the top and the support wall, all collapse joints being of soft and flexible rubber flexibly connecting said sturdy walls and providing for predictable and compact collapse of the seat and nesting of said sturdy walls in deflation, and providing for unfolding of said sturdy walls to expand the seat during inflation;

b) an air inlet to the seat;

c) an inflation air hose;

d) an inflation coupling for connecting the inflation air hose to the air inlet;

e) a pressurized air supply;

f) an inflation valve for admitting air to the seat through the inflation air hose and the air inlet;

g) an inflation switch for actuating the inflation valve;

h) an air outlet;

i) deflation air hose;

j) a deflation coupling for connecting the deflation air hose to the air outlet; and k) a deflation valve for bleeding air from the seat.

21. A handicap bath assist device comprising:

a) an inflatable seat of resilient material which is dimensioned to fit, in a fully inflated configuration, in an end of a bathtub, said inflatable seat having a top, a top front wall, a bottom front wall, a base wall, a rear wall, a left side wall, a right side wall, a support wall, a front top collapse joint between the top and the top front wall, a front wall collapse joint between the top front wall and the bottom front wall, a front base collapse joint between the bottom front wall and the base wall, a rear wall collapse joint between the rear wall and the support wall, a rear top collapse joint between the top and the support wall, and one or more suction cups on the outside surface of the base wall and the rear wall to secure the seat to the bathtub during use; the top front wall, the bottom front wall, the base wall, the rear wall and the support wall being sturdy walls constructed of stiff resilient material and providing structural stability to the seat; the collapse joints being constructed of flexible resilient material and flexibly connecting said sturdy walls and providing for predictable and compact collapse of the seat and nesting of said sturdy walls in deflation and providing for unfolding of said sturdy walls to expand the seat during inflation; and the top, the left side wall and the right side wall being flexible and being constructed of flexible resilient material and permitting and conforming to nesting and unfolding of said flexibly connected sturdy walls;

b) an air inlet to the seat;

c) means for controllably supplying pressurized air to the seat through the air inlet;

d) an air outlet from the seat; and e) means for controllably bleeding air from the seat through the air outlet.

22. A handicap bath assist device as claimed in claim 21 wherein the resilient material is rubber.

23. A handicap bath assist device as claimed in claim 21 wherein the air inlet and the air outlet have a common orifice.

24. A handicap bath assist device as claimed in claim 21 wherein the means for controllably supplying pressurized air to the seat comprises inflation air hose, an inflation air valve, an inflation valve switch, a pressurized air supply, and a means for connecting the inflation air hose to the air inlet.

25. A handicap bath assist device as claimed in claim 21 wherein the means for controllably bleeding air from the seat comprises a deflation air hose, a deflation air valve, a deflation valve switch, and a means for connecting the deflation air hose to the air outlet.

26. A handicap bath assist device as claimed in claim 21 wherein the means for controllably bleeding air from the seat includes a means for accelerated evacuation of the air.

27. A handicap bath assist device as claimed in claim 21 wherein the means for controllably bleeding air from the seat comprises deflation air hose, a deflation air valve, a deflation valve switch, a venturi suction device, a source of pressurized air for the venturi suction device, and a means for connecting the deflation air hose to the air outlet.

28. A handicap bath assist device as claimed in claim 21 wherein the sturdy walls are constructed of heavy duty and stiff rubber, the top and the side walls are constructed of soft and flexible rubber, and the collapse joints are constructed of soft and flexible rubber.

* * * * *